US006179526B1

(12) United States Patent
Knight et al.

(10) Patent No.: US 6,179,526 B1
(45) Date of Patent: Jan. 30, 2001

(54) METHOD FOR FORMING A PILE ISOLATION VOID

(76) Inventors: David Knight; Paul A. Knight; David A. Belcher, all of P.O. Box 2586, Humble, TX (US) 77347

( * ) Notice: Under 35 U.S.C. 154(b), the term of this patent shall be extended for 0 days.

(21) Appl. No.: 09/231,441

(22) Filed: Jan. 14, 1999

(51) Int. Cl.[7] ..... E02D 7/00; E02D 11/00; B27K 1/00

(52) U.S. Cl. ..... 405/232; 405/230; 405/231; 405/251; 405/257; 52/170; 52/515; 52/721.1

(58) Field of Search ..... 405/230, 231, 405/232, 236, 240, 243, 251, 257; 52/170, 515, 721.1, 721.4, 722.1, 723.2

(56) References Cited

U.S. PATENT DOCUMENTS

| | | | | |
|---|---|---|---|---|
| 3,326,006 | * | 6/1967 | Mount | 405/251 |
| 3,487,646 | * | 1/1970 | Gatien | 405/257 |
| 3,555,833 | * | 1/1971 | Correa | 405/232 |
| 3,630,037 | * | 12/1971 | Howard | 405/232 |
| 3,703,812 | * | 11/1972 | Newton | 52/170 X |
| 3,851,483 | * | 12/1974 | Holley, Jr. | 405/232 |
| 4,070,867 | | 1/1978 | Cassidy . | |
| 4,585,681 | | 4/1986 | Kidera et al. . | |
| 4,746,691 | * | 5/1988 | Fuhrman | 524/40 |
| 4,818,148 | | 4/1989 | Tadeka et al. . | |
| 4,838,737 | * | 6/1989 | Quimby | 405/230 |
| 4,907,916 | * | 3/1990 | Hartman | 405/236 |
| 4,915,544 | * | 4/1990 | Lin | 405/243 |
| 5,108,227 | * | 4/1992 | Bergey | 405/231 X |
| 5,228,807 | * | 7/1993 | Willcox, Jr. | 405/232 |
| 5,288,175 | * | 2/1994 | Knight | 405/230 |
| 5,669,736 | * | 9/1997 | Lin | 405/251 X |
| 5,713,701 | * | 2/1998 | Marshall | 405/232 |

* cited by examiner

*Primary Examiner*—Eileen D. Lillis
*Assistant Examiner*—Jong-Suk Lee
(74) *Attorney, Agent, or Firm*—Harrison & Egbert

(57) ABSTRACT

A method of forming a pile isolation void including forming a foundation pile having an enlarged cross-section within a specific localized section and driving the foundation pile a desired distance into the earth so as to form a pile isolation void directly above the enlarged cross-section. The enlarged cross-section can be located at the bottom of the foundation pile or along the length of the foundation pile. The pile isolation void is an annular void extending around the foundation pile above the enlarged cross-section. This pile isolation void can be filled with a material, such as liquid, gel, or a solid material different than the material of the pile or of the earth. The enlarged cross-section can be a collar placed upon the foundation pile, or integrally formed with the foundation pile.

8 Claims, 4 Drawing Sheets

METHOD FOR FORMING A PILE ISOLATION VOID

TECHNICAL FIELD

The present invention relates generally to foundation piles. More particularly, the present invention relates to methods for installing foundation piles into the earth. Furthermore, the present invention relates to methods and apparatus whereby the adverse effects of skin friction between the upper portion of piles and the earth are avoided or reduced.

BACKGROUND ART

Piles utilize both end bearing and skin friction on the outer surface of the pile to obtain adequate load capacity. The performance of piles has historically been better than for other shallower foundation systems. However, under certain soil conditions, piles can have problems. Specifically, piles are sometimes used in areas having thick layers of underconsolidated soil sandwiched between stiff soil at the surface and stiff or dense soil at a significant depth. As this middle layer of underconsolidated soil continues to compress or consolidate over time, the subsequent downward movement of the upper stiff layer of soil creates negative skin friction on the upper portion of the pile, thereby increasing the downward load. This increased downward load has been known to cause failure of piles.

Another soil condition that can cause problems with piles occurs when soil shrinkage from extremely dry weather causes a gap to develop between the soil and the pile surface. This shrinkage gap causes a loss of skin friction in the upper portion of the pile, thereby reducing the capacity of the pile, sometimes to the point of failure. Since there is loss of skin friction, the original calculations made to determine the amount of support for the structure can grossly underrepresent the ultimate capacity provided. Since there is a loss of skin friction in the upper portion of the pile, the only support for the structure will come from skin friction and bearing in the lower portion of the pile.

Still another soil condition that can affect these piles is soil heave or swelling. In particularly cold weather climates, the soil freezes during cold winter months. Whenever the soil freezes, the soil within the frost zone can expand due to freezing. In areas with extremely expansive soils, the soil can swell during very wet periods. Both freezing and wetting of soils can cause a heaving action on the pile which can permanently damage the pile. As such, if skin friction exists between the pile and the earth in the upper portion, then damaging uplifts of the pile can occur.

In the past, various patents have issued relating to the skin friction affecting such piles.

U.S. Pat. No. 4,070,867, issued on Jan. 31, 1978 to F. G. Cassidy, describes a building pile structure and system that utilizes a skin friction pile having a casing or sleeve of somewhat larger diameter than the outside diameter of the pile. This casing or sleeve is driven over the pile either simultaneously with the driving of the pile or driven somewhat in advance of the pile so as to isolate the pile from certain areas of the surrounding soil for a portion of the total depth into which the pile is driven.

U.S. Pat. No. 4,585,681, issued on Apr. 29, 1986 to Kidera et al., describes a frost damage-proof pile for installment in a frigid region where the pile is subjected to a freezing and frost heaving force, such as which occurs with permanently or seasonally frozen soil terrain. A tubular sheath member is fitted over the pile surface and has a length longer than the thickness of an active or seasonally frozen soil layer of the terrain in which the pile is installed. At least a portion of the length of the pile is formed as an extensible section, and at least the lower end of the sheath member is secured to the pile at or below a position corresponding to the bottom region of the active or seasonally frozen soil layer. A fluid material is filled into the space defined between the pile and the sheath member. The frost heaving force caused to exist upon freezing of the active or seasonally frozen soil layer as well as negative friction caused to exist in summer are inhibited from affecting the pile due to sliding of the sheath member relative to the pile.

U.S. Pat. No. 4,818,148, issued on Apr. 4, 1989 to Takeda et al., describes a frost damage-proofed pile in which a covering is applied onto the outer surface of the pile. This covering includes a steel pipe which surrounds a predetermined length of the pile so as to reduce a frost heaving force or negative friction acting on the pile in a frigid area. The covering is closely adhered by an adhesion layer to the pile over a given length thereof. The covering member includes a smooth-surfaced plastic covering or elastic covering. A rugged surface covering may be provided below the smooth surfaced covering.

It is an object of the present invention to provide a method and apparatus for avoiding the problems associated with adverse skin friction in the upper portion of the pile shaft.

It is still another object of the present invention to provide a method and apparatus which reduces or eliminates the effects of negative skin friction.

It is another object of the present invention to provide a method and apparatus which serves to reduce or eliminate the effects of shrinkage induced loss of contact with the soil.

It is still another object of the present invention to provide a method and apparatus which reduces or eliminates the effect of soil heave due to swelling clays or freezing of soil in a frost zone.

It is still another object of the present invention to provide a method and apparatus which is easy to install, relatively inexpensive and easy to manufacture.

These and other objects and advantages of the present invention will become apparent from a reading of the attached specification and appended claims.

SUMMARY OF THE INVENTION

The present invention is a method of forming a pile isolation void comprising the steps of: (1) forming a foundation pile having an enlarged cross-section within a specific localized section; and (2) driving the foundation pile a desired distance into the earth so as to form the pile isolation void directly above the enlarged cross-section.

In one embodiment of the present invention, the foundation pile is formed at least of first, second and third pile segments. The second pile segment will have the enlarged cross-section with a width greater than a width of the third pile segment. The first pile segment is driven the desired distance into the earth. The second pile segment is driven into the earth until the second pile segment resides on the first pile segment. The third pile segment is placed into the earth such that the third pile segment resides on the opposite side of the second pile segment from the first pile segment. The pile isolation void extends around the third pile segment. Within the concept of this embodiment of the present invention, the first pile segment can include a plurality of first pile segments and the third pile segment can comprise a plurality of third pile segments.

In another embodiment of the present invention, the step of forming includes forming an elongated pile having a desired length and affixing a collar to the elongated pile. The collar has the enlarged cross-section. The collar can be attached to either the bottom of the elongated pile or in any position between the top end and the bottom end of the elongated pile. The pile isolation void will extend directly above the collar when the elongated pile is driven into the earth.

In another form of the present invention, a pile segment is formed with the enlarged cross-section and an elongated pile is formed with a width dimension less than the width dimension of the enlarged cross-section. The pile segment is driven the desired distance into the earth. The elongated pile is placed into the earth such that an end of the elongated pile resides on the pile segment and extends upwardly therefrom. The pile isolation void extends along and around the elongated pile.

In another form of the present invention, enlarged cross-sections can function as stabilizers. In this method of the present invention, the foundation pile is formed with a first enlarged cross-section and a second enlarged cross-section. These enlarged cross-sections are spaced from each other along the foundation pile. The enlarged cross-sections directly engage the earth so as to stabilize the foundation pile within the void.

In the present invention, the pile isolation void can be at least partially filled with a material different than the material of the foundation pile and different than the earth. This material can be a liquid, a gel, a hydrophilic granular plastic or a solid. In particular, a sleeve can be placed within the void above the enlarged cross-section so as to be interposed between the earth and the foundation pile. This sleeve can be formed of any material.

DETAILED DESCRIPTION OF THE INVENTION

Figure 1:
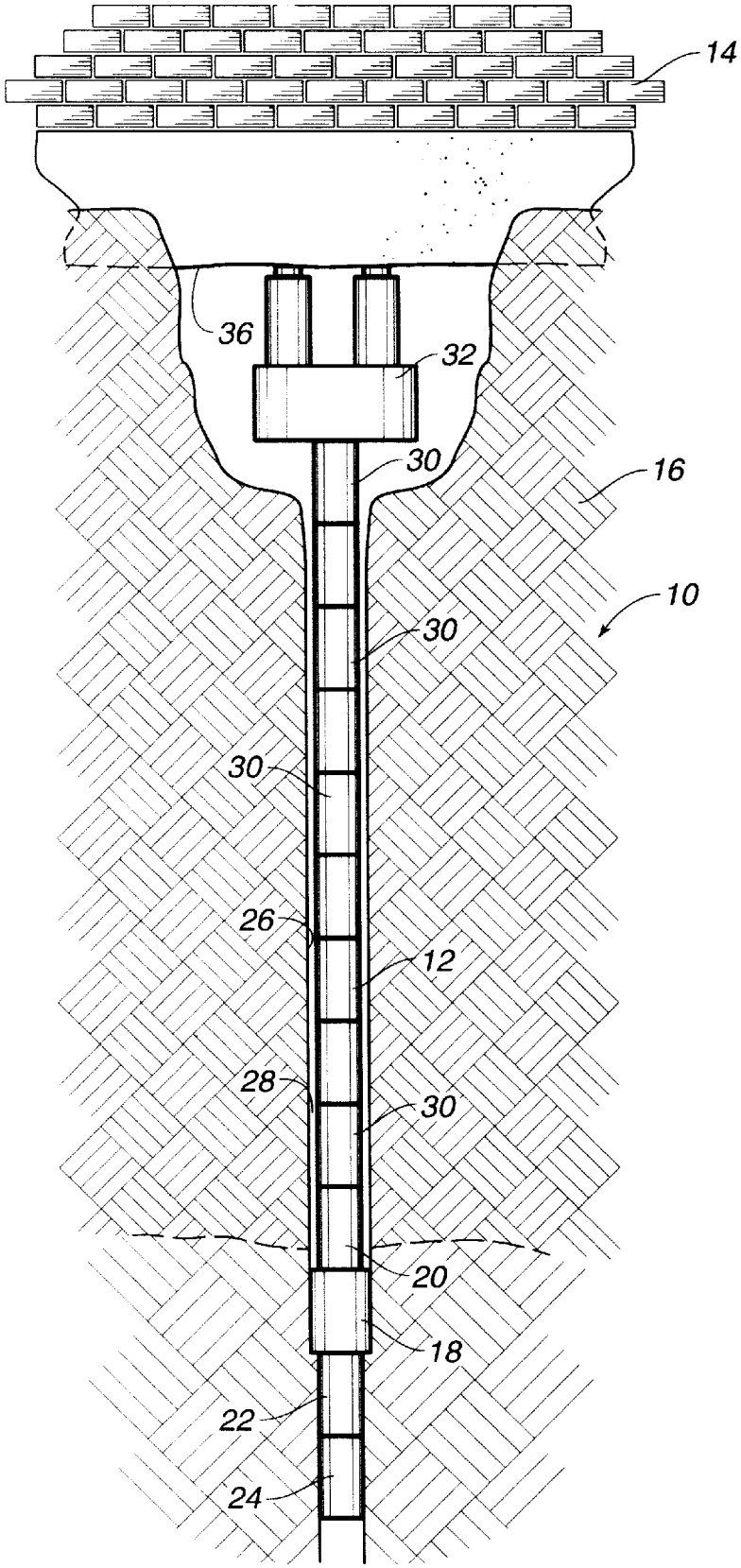
FIG. 1 is a cross-sectional view showing the foundation pile of the present invention as assembled in an area experiencing soil shrinkage or frost-related heave.

Referring to FIG. 1, there is shown at 10 the method and apparatus of the present invention for the forming of a pile isolation void. The segmented piles 12 are used for the support of a structure 14 above the earth 16. The earth 16 is a section of the earth that can experience soil shrinkage or frost-related heave.

In the method of the present invention, the foundation piles 12 will include a pile 18 of an enlarged cross-section within a specific localized section. The foundation piles 12 are driven a desired distance into the earth 16 so as to form a pile isolation void 28 directly above the enlarged cross-section 18.

FIG. 1 shows one form of the method of the present invention. In the method shown in FIG. 1, the first step is for the pile segment 18 having the enlarged cross-section to be driven into the earth for a desired distance from the structure 14. The pile segment 18 has a width dimension (or diameter) which is greater than the width dimension (or diameter) of an adjacent pile segment 20. In FIG. 1, it can be seen that a plurality of lowermost pile segments 22 and 24 are installed into the earth prior to the installation of the pile segment 18 of enlarged cross-section.

Since the pile segment 18 has an enlarged cross-section which is greater than the cross-section of the adjacent pile segment 20, along with the multiple other pile segments extending above the pile segment 20, the enlarged cross-section pile segment 18 will form the hole 26 in the earth 16. As such, a pile isolation void 28 is formed between the exterior surface of the pile segment 20 and the wall of the hole 26. This pile isolation void will extend from the top surface of the enlarged pile segment 18, as an annular void, to the top of the pile segments. The diameter of the enlarged cross-section pile segment 18 (or the diameter of the hole 26) should be between 1.1 and 1.5 times larger than the diameter of the adjacent pile segment 20. As such, the pile isolation void 28 will be formed of a sufficient annular size so as to reduce the effects of the loss of skin friction caused by extremely dry weather conditions or the damage caused by soil heave.

In FIG. 1, for the purposes of illustration, it can be seen that there are a plurality of additional pile segments 30 which are arranged in stacked relationship onto the pile segment 20. Each of these pile segments 20 and 30 are configured so as to reside in coaxial relationship with the enlarged cross-section pile segment 18. So that problems associated with skin friction are avoided, the pile segments 20 and 30 will reside entirely within the enlarged cross-sectional area of the pile segment 18. In other words, the exterior surfaces of the pile segments 20 and 30 should not contact the wall of the hole 26. A cap 32 is affixed to the uppermost pile segment. The top of cap 32 will serve to support the foundation 36 of the structure 14 thereon.

The enlarged cross-section pile segment 18 is installed just prior to reaching the required load capacity. The pile isolation void 28 is an annular void that is created as the pile driving continues to the full load requirement. This annular void is not created to be backfilled since its only purpose is to enable the driving of the pile without allowing any skin friction to develop within the weather-affected upper portion of the foundation pile 10. Since skin friction in the upper portion of the foundation pile 10, identified by segments 20 and 30, is not present during the installation, any future loss of contact in this upper area due to soil shrinkage will be of no consequence. As such, the foundation pile 10 of the present invention will be sufficient so as to support the structure 14 and will avoid any erroneous calculation of load capacities based upon anticipated skin friction.

The enlarged cross-section pile segment 18 can also be utilized to prevent damage to a pile resulting from the heaving of the soil within the weather-affected zone. In this arrangement, the enlarged cross-section pile segment 18 would be installed near the end of the driving sequence so as to produce a pile isolation void 28 at least as deep as the weather-affected zone, while still obtaining full load capacity.

The annular void created between the exterior surface of the pile segments 20 and 30 and the wall of the hole 26 will prevent any weather-related heaving from impacting the integrity of the foundation pile 10.

Figure 2:
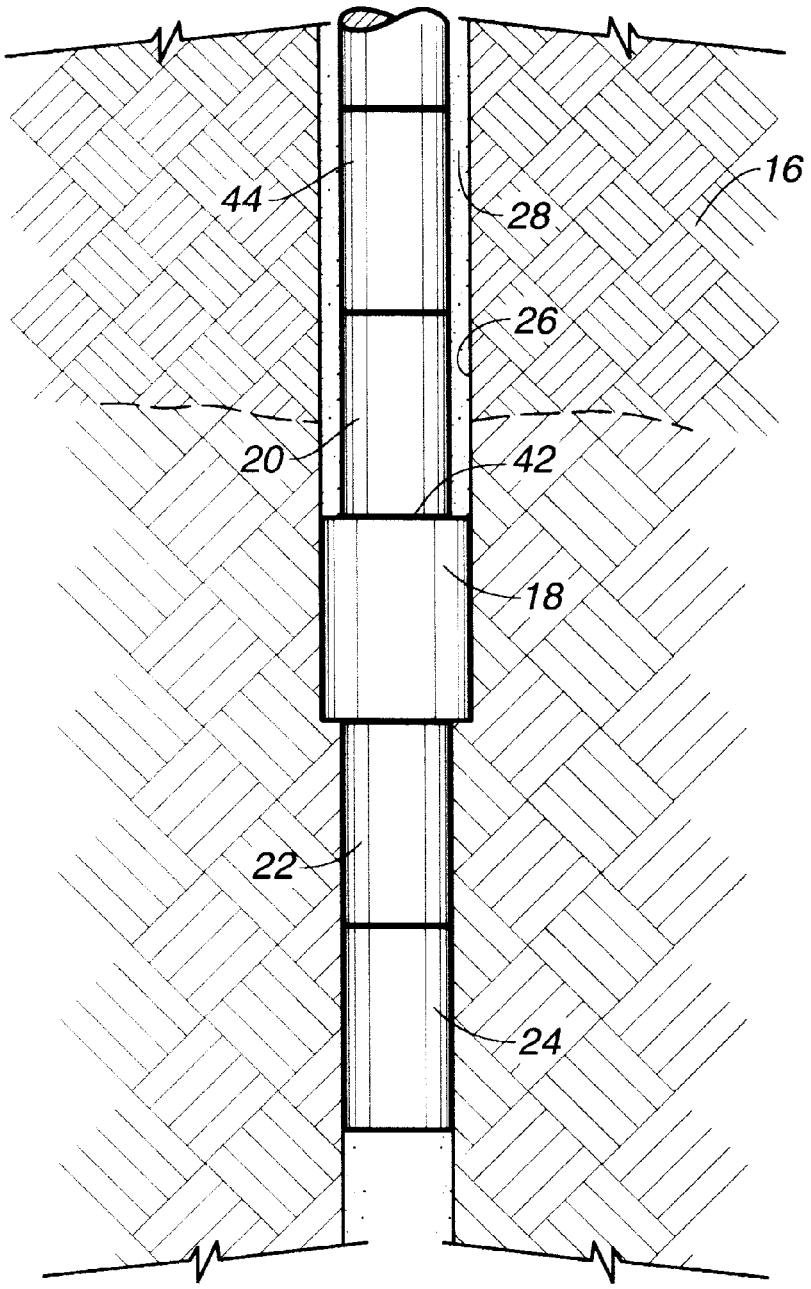
FIG. 2 is a detailed isolated view showing the arrangement of the various pile segments in accordance with a method of the present invention.

FIG. 2 is an isolated view of the method and apparatus shown in FIG. 1. As can be seen, the enlarged cross-section pile segment 18 has an exterior surface which contacts the wall of the hole 26. As such, the enlarged cross-section pile segment 18 is rigidly received within the earth. Since the enlarged cross-section pile segment 18 is below the frost zone, it will not be affected by weather-related heaving. The lowermost piles 22 and 24 can have a diameter which is less than or equal to the first pile 18. These lowermost piles 22 and 24 can extend, as deeply as desired, into the remaining portion of the earth 16.

As can be seen in FIG. 2, the adjacent pile segment 20 is positioned in stacked relationship onto the top surface 42 of the enlarged cross-section pile segment 18. The adjacent pile segment 20 resides within the enlarged cross-sectional area of pile segment 18. In view of the relationship between the smaller circumference of the adjacent pile segment 20 and the larger circumference of the enlarged cross-section pile segment 18, the pile isolation void 28 is formed between the exterior surface of the pile segment 20 and the wall of the hole 26. This pile isolation void 28 is formed without the need for special attachments, tubes, or structural members. The enlarged cross-section pile segment 18 will have an outer diameter which is 1.1 to 1.5 times larger than the outer diameter of the adjacent pile segment 20.

Another pile segment 44 is installed on top of the pile segment 20. The pile segment 44 will have an outer diameter which matches the outer diameter of the pile segment 20. Generally, this pile segment 44 will reside in coaxial relationship with the second pile segment 20.

In a normal fashion, each of these segments is installed by driving the segments sequentially into the earth. The pile isolation void 28 is formed by driving the enlarged cross-section pile segment 18 into the earth and then placing the upper pile segments onto the enlarged cross-section pile segment 18.

Although FIGS. 1 and 2 show one form of the method of the present invention, it needs to be realized that various other forms of the present invention can be accomplished within the broad concept of the present invention. It is believed that the present invention will be utilized on both new construction and underpinning piles. FIGS. 3–6 show such alternative forms of the present invention.

Figure 3:
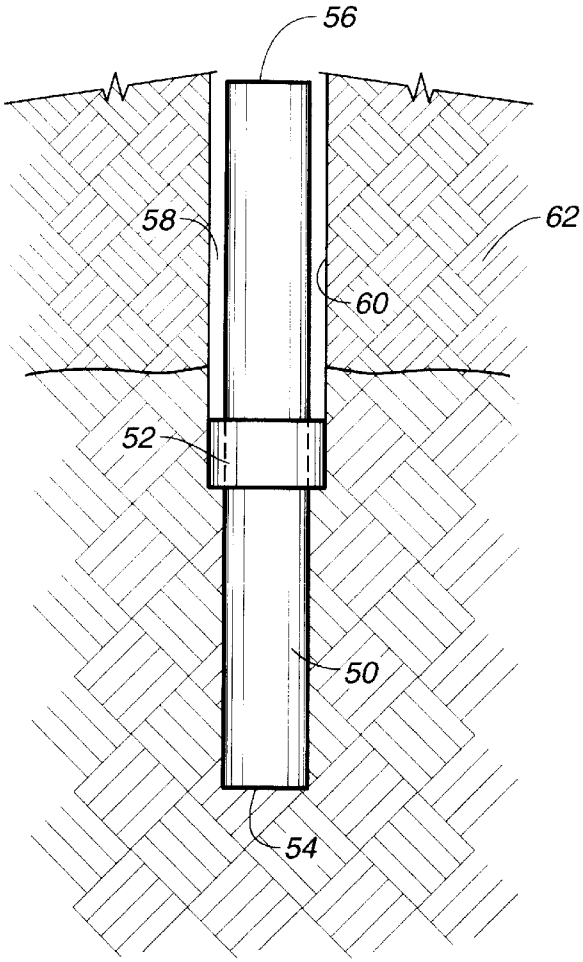
FIG. 3 is a detailed isolated view showing the method of the present invention as utilizing a collar along the foundation pile.

FIG. 3 shows the method of the present invention in which the foundation pile includes an elongated pile 50 having a collar 52 affixed thereto. The collar 52, in combination with the elongated pile 50, has the enlarged cross-sectional area. In FIG. 3, it can be seen that the collar 52 is attached along the length of the elongated pile 50 between the bottom end 54 and the top end 56. The pile isolation void 58 is formed so as to extend between the elongated pile 50 and the wall 60 of the earth 62. The collar 52 serves to form the pile isolation void 58. In the method of the present invention, the elongated pile 50 and the attached collar 52 are driven into the earth for the desired distance such that the pile isolation void 58 extends directly above the collar 52.

Figure 4:
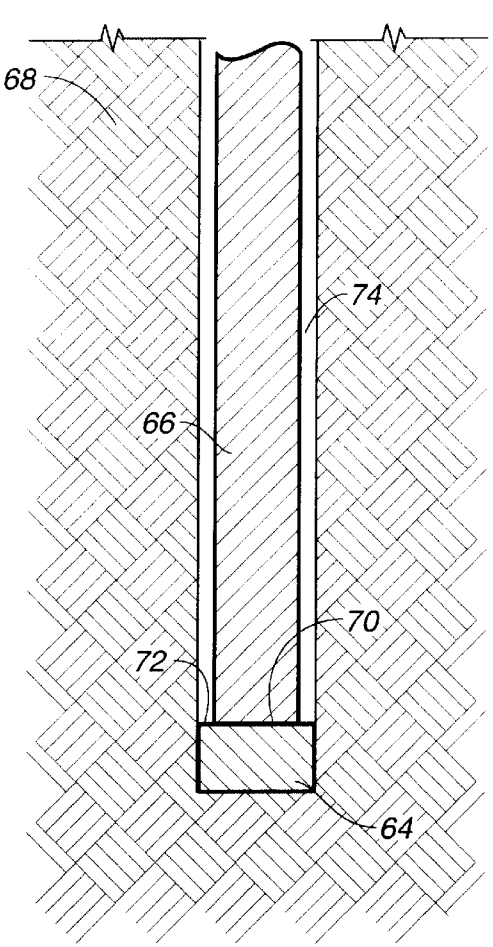
FIG. 4 is a cross-sectional view showing the method of the present invention as using an enlarged bottom pile segment.

FIG. 4 shows another form of the present invention having a pile segment 64 which is formed with an enlarged cross-section. An elongated pile 66 is formed so as to have a width dimension (or diameter) less than the width dimension (or diameter) of the pile segment 64. In the method of the present invention, the pile segment 64 is driven into the earth 68 for the desired distance. The elongated pile 66 is placed into the earth 68 such that an end 70 of the elongated pile 66 resides on the top surface 72 of the pile segment 64. The pile isolation void 74 will extend along the elongated pile 66 above the pile segment 64.

Figure 5:
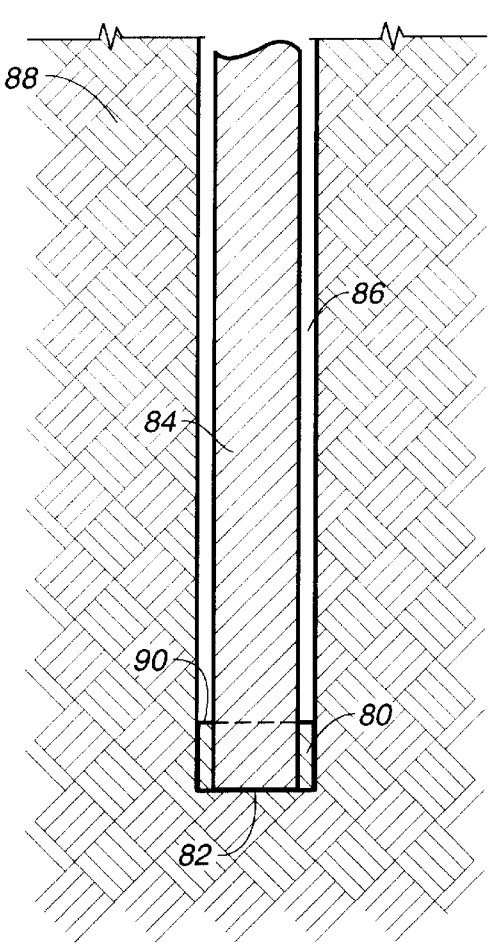
FIG. 5 is a cross-sectional view showing the method of the present invention as including an enlarged collar at the bottom of the foundation pile.

FIG. 5 shows an alternative form of the present invention in which a collar 80 is attached to an end 82 of an elongated pile 84. The elongated pile, along with the collar 80, are driven into the earth so as to form the pile isolation void 86. Pile isolation void 86 will extend between the outer surface of the elongated pile 84 and the earth 88 directly above the top surface 90 of the collar 80.

Figure 6:
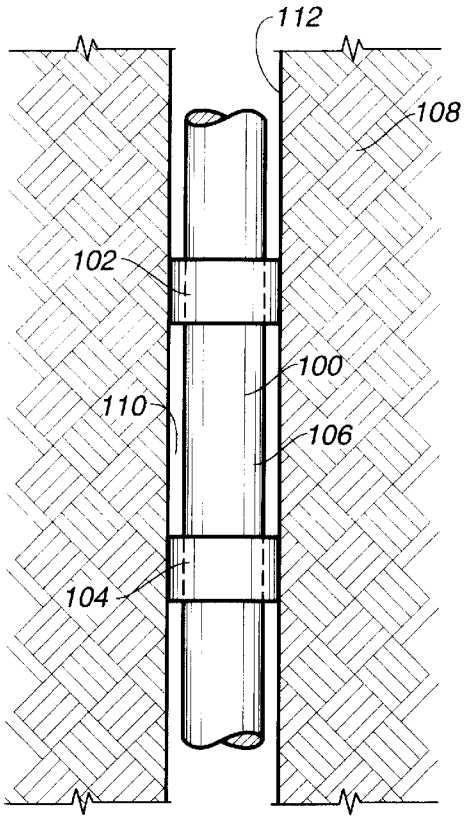
FIG. 6 shows the method of the present invention as utilizing enlarged cross-sections in the form of stabilizers along the foundation pile.

FIG. 6 shows a further alternative form of the present invention in which the foundation pile 100 includes a first enlarged cross-sectional area 102 and a second enlarged cross-sectional area 104. Enlarged cross-sectional areas 102 and 104 are in spaced relationship to each other along the elongated pile 106. The enlarged cross-sectional areas 102 and 104 serve as stabilizers for the foundation pile 100 within the earth 108. The enlarged cross-sectional areas 102 and 104 can be integrally formed with the elongated pile 106, can be attached as pile segments between separate segments of the elongated pile 106, or be attached as collars around the outer diameter of the elongated pile 106. When the enlarged cross-sectional areas 102 and 104 are attached as collars, the collars will reside in coaxial and parallel relationship. In this method of the present invention, the foundation pile 100, along with its enlarged cross-sectional areas 102 and 104, is driven into the earth 108 so as to form the pile isolation void 110 between the wall of the hole 112 and the outer surface of the elongated pile 106. The outer surfaces of the enlarged cross-sectional areas 102 and 104 will contact the wall 112 of the hole so as to provide stability for the foundation pile 100.

Figure 7:
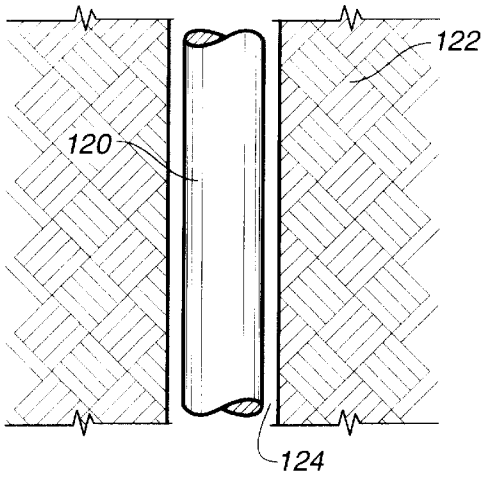
FIG. 7 is an isolated view showing air as filling the pile isolation void.

Within the concept of the present invention, the pile isolation void can be filled with various materials so as to allow the soil to subside without causing undue downward load on the pile from the negative skin friction. The fill material can be suitable for preventing adhesion and for reducing skin friction in the pile isolation void. FIG. 7 shows the foundation pile 120 and the earth 122. The pile isolation void 124 is illustrated as filled with air.

Figure 8:
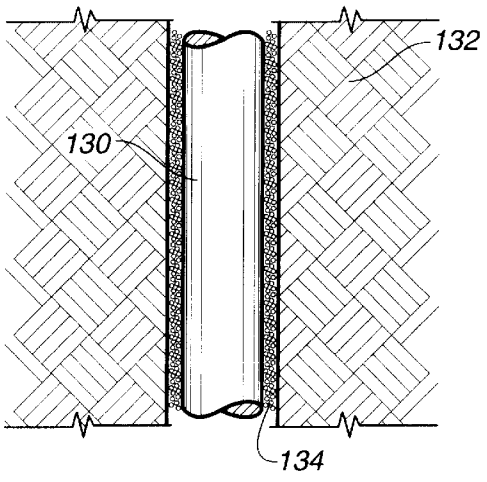
FIG. 8 is a detailed view showing a gel or hydrophilic granular plastic material filling the pile isolation void.

FIG. 8 shows the pile 130 and the earth 132. The pile isolation void 134 is filled with a gel material or with a hydrophilic granular plastic. When this hydrophilic granular plastic contacts water, such plastic will form a type of gel material so as to reduce skin friction between the foundation pile 130 and the wall of the hole in the earth 132.

Figure 9:
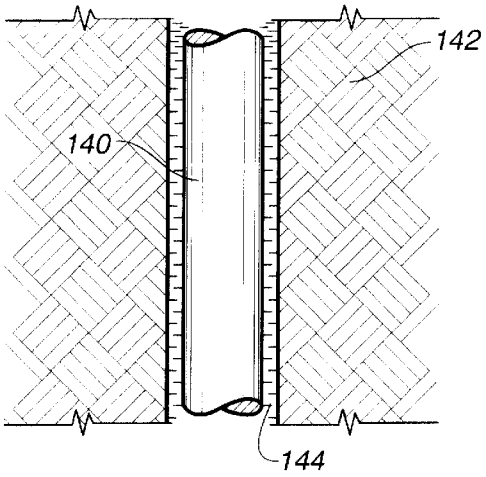
FIG. 9 is a detailed view showing a liquid as filling the pile isolation void.

FIG. 9 shows the foundation pile 140 and the earth 142. The pile isolation void 144 is filled with a suitable liquid material.

Figure 10:
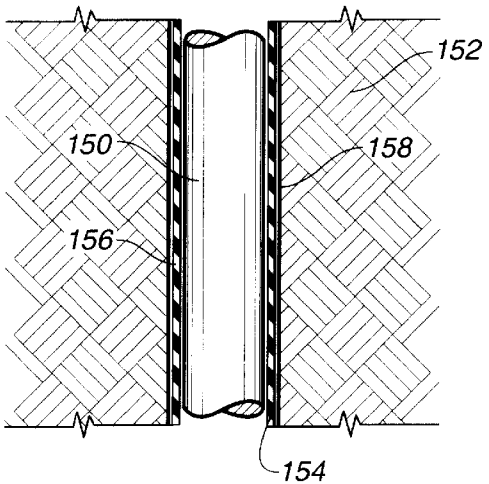
FIG. 10 is an isolated view showing a plastic sleeve filling the pile isolation void.

FIG. 10 shows the foundation pile 150 and the earth 152. The pile isolation void 154 is filled with a solid material 156. The solid material 156 is actually a plastic sleeve which is inserted into the void around the outer diameter of the pile 150. This sleeve 156 can be placed on the pile 150 above the enlarged cross-sectional area so as to be interposed between the wall of the hole 158 and the exterior surface of the pile 150.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

What is claimed is:

1. A method of forming a pile isolation void comprising:

forming a first pile segment;

driving said first pile segment a desired distance into the earth;

forming a second pile segment having an enlarged cross-section;

separately driving said second pile segment into the earth until said second pile segment resides on said first pile segment so as to form the pile isolation void directly above said enlarged cross-section;

forming a third pile segment having a width less than a width of said enlarged cross-section; and placing said third pile segment into the earth such that said third pile segment resides in unconnected relationship on an opposite side of said second pile segment from said first pile segment, said pile isolation void extending around said third pile segment.

2. The method of claim 1, said first pile segment comprising a plurality of first pile segments, said third pile segment comprising a plurality of third pile segments residing in stacked and unconnected relationship.

3. The method of claim 1, further comprising:

at least partially filling said pile isolation void with a material different from a material of said foundation pile and different from the earth.

4. The method of claim 3, said material being a liquid.

5. The method of claim 3, said material being a gel.

6. The method of claim 3, said material being a hydrophilic granular plastic.

7. The method of claim 3, said material being a solid.

8. A method of forming a pile isolation void comprising:

forming a pile segment having an enlarged cross-section with a width dimension;

forming an elongated pile having a width dimension less than said width dimension of said enlarged cross-section;

driving said pile segment the desired distance into the earth so as to form the pile isolation void directly above said enlarged cross-section; and placing said elongated pile into the earth such that an end of said elongated pile resides in unconnected relationship on said pile segment and extends upwardly therefrom, said pile isolation void extending along and around said elongated pile.

* * * * *